United States Patent [19]

Jungkind

[11] Patent Number: 4,489,956

[45] Date of Patent: Dec. 25, 1984

[54] HEELHOLDER FOR SAFETY SKI BINDINGS

[75] Inventor: Roland Jungkind, Garmisch-Partenkirchen, Fed. Rep. of Germany

[73] Assignee: Marker Patentvertwertungsgesellschaft mbH., Baar, Switzerland

[21] Appl. No.: 347,099

[22] Filed: Feb. 9, 1982

[30] Foreign Application Priority Data

Feb. 25, 1981 [DE] Fed. Rep. of Germany ..... 3107036

[51] Int. Cl.[3] ..... A63C 9/084

[52] U.S. Cl. ..... 280/632; 280/634

[58] Field of Search ..... 280/626, 628, 631, 632, 280/633, 634

[56] References Cited

U.S. PATENT DOCUMENTS

| | | | |
|---|---|---|---|
| 3,432,180 | 3/1969 | Suhner | 280/626 |
| 3,529,846 | 9/1970 | Vöster | 280/626 |
| 3,550,996 | 12/1970 | Marker | 280/626 |
| 3,554,572 | 1/1971 | Hashioka | 280/626 |
| 3,830,510 | 8/1974 | Staufer | 280/633 |

*Primary Examiner*—Joseph F. Peters, Jr.
*Assistant Examiner*—Joseph G. McCarthy
*Attorney, Agent, or Firm*—Woodling, Krost, Rust & Hochberg

[57] ABSTRACT

A heelholder for a safety ski binding which is manually adjustable from an open condition to a closed condition, including a soleholder, a first locking member biased in a forward direction, an actuating member mounted on the soleholder for engaging the first locking member to releasably hold the soleholder in the closed position, a second locking member for releasably locking the adjusting member in engagement with the first locking member when the soleholder is in the closed position, a manual release mechanism, and an interposed member located between the manual release mechanism and the second locking member for enabling movement of the soleholder from the open condition to closed condition and the locking by the second locking member of the adjusting member in engagement with the first locking member upon actuation of the manual release mechanism during movement of the soleholder from the open to the closed condition.

8 Claims, 2 Drawing Figures

HEELHOLDER FOR SAFETY SKI BINDINGS

Figure 1:
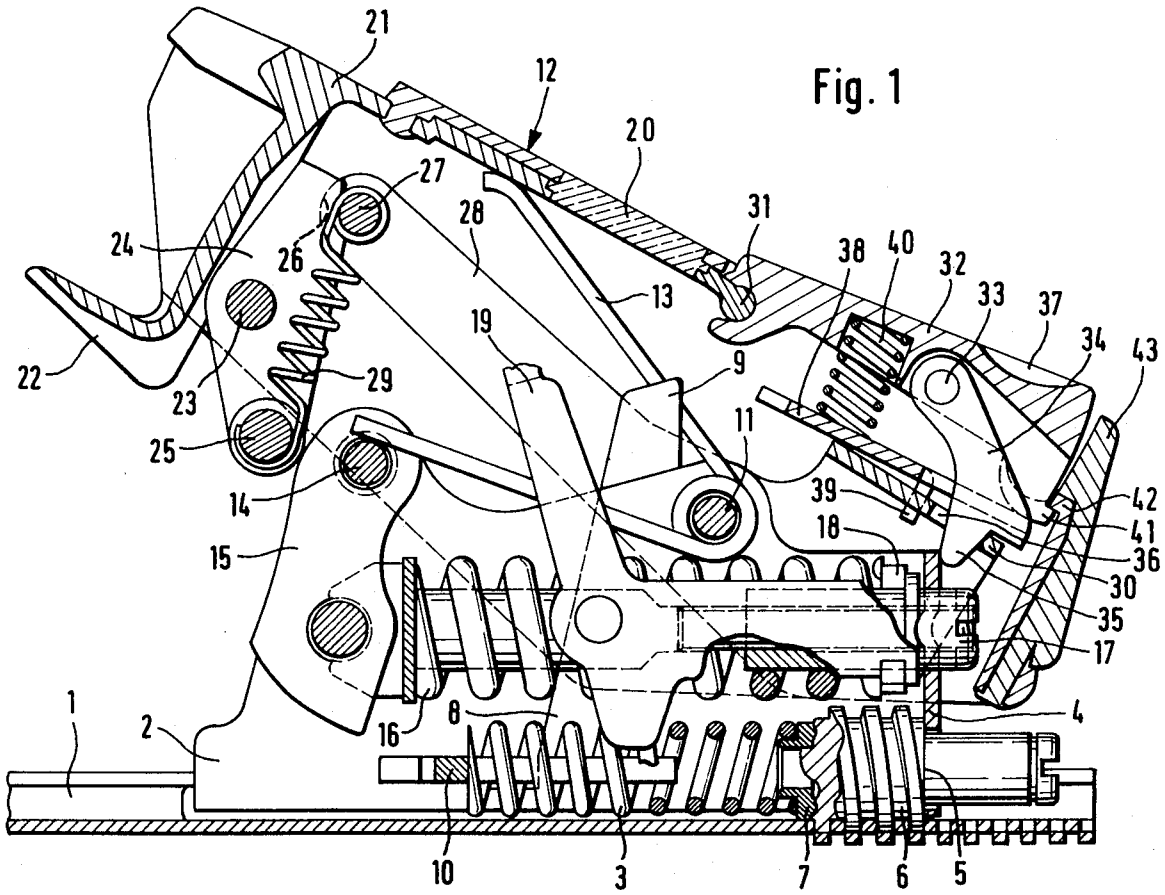

This invention relates to a heelholder for safety ski bindings, which heelholder comprises a soleholder, which is pivoted on a transverse horizontal axis and biased by an opening spring and provided with a closing pedal, a first locking member, which is pivoted on an axis that is parallel to the pivotal axis of the soleholder or which is slidable in the longitudinal direction of the ski and biased by a release-controlling spring and when the heelholder is in its operative position engages from behind a member which is movably mounted in the soleholder and which when the heelholder is in its operative position is locked by a second locking member, which is pivotally movable with the soleholder, and a manually operable mechanism for moving the second locking member against the force of a retaining spring to an unlocking position so as to arbitrarily open the heelholder.

Such heelholders have been disclosed in German patent application No. P 30 33 021.3 and compared to other known heelholders afford the advantage that the soleholder is automatically moved to its open position also when the skiing boot has been released by the toe unit so that there is no need for a manipulation at the heelholder when the skier desires to step into the binding after a release in response to a twisting fall.

But such bindings have the disadvantage that the soleholder is also in its open position when the ski is being transported and stored; this is undesirable for various reasons. For instance, when the skis are carried on the roof of a car, salt water from the road may be splashed into the unprotected binding. Conventional ski bags usually cannot be employed because they are not so wide that they can receive open heelholders.

For this reason it is an object of the present invention to provide an improved heelholder which is of the kind described first hereinbefore and which can be closed in that the skiing boot is stepped into the binding or arbitrarily by hand, e.g., when the binding is to be transported or stored.

This is accomplished in accordance with the invention in that an interposed member is provided, which is disposed between the handle and the second locking member and is mounted to be movable relative to the second locking member so that during a pivotal movement of the soleholder to its operative position by an actuation of the handle said interposed member moves past a stop, which serves for an automatic unlocking, to a position in which the interposed member permits the second locking member to move to its locking position. The heelholder cannot assume that position for transport when this is not intended because when the handle is actuated to open the heelholder the soleholder must be pivotally moved to its operative position. When the heelholder is in position for transport, the skier can step into the binding after a single actuation of the handle. When the skiing boot is subsequently released by the binding automatically or by an arbitrary operation, the heelholder will move automatically to its open position so that the binding will always be ready to receive the skiing boot. For a subsequent transport, the above-described operations must be performed to lock the soleholder in its closed position.

If the heelholder comprises a baseplate, which is adapted to be secured to the top surface of the ski and on which a carriage is mounted to be slidable in the longitudinal direction of the ski, and a contact pressure spring is provided, which holds the carriage in its forward end position when there is no skiing boot in the binding, the stop is suitably fixed to the baseplate and the handle consists suitably of a lever, which is pivoted to the soleholder.

The second locking member may consist of a two-armed lever, which has a locking arm and a second arm, which is engaged by the interposed member. In that case the interposed member consists suitably of a lever which is pivoted to the second arm of the second locking member and extends over the second locking member and is urged toward the latter by a spring. If this arrangement is embodied in a heelholder of the above-mentioned kind, which comprises a carriage biased by a contact pressure spring, the carriage will be in its forward end position when there is no skiing boot in the binding. When the handle is then actuated and the soleholder is turned down from its open position, then the interposed member will be held back by the stop, and when the handle is released the second locking member can move to and remain in its locking position so that the soleholder remains closed.

Additional features of the heelholder according to the invention are apparent from the dependent claims.

Figure 2:
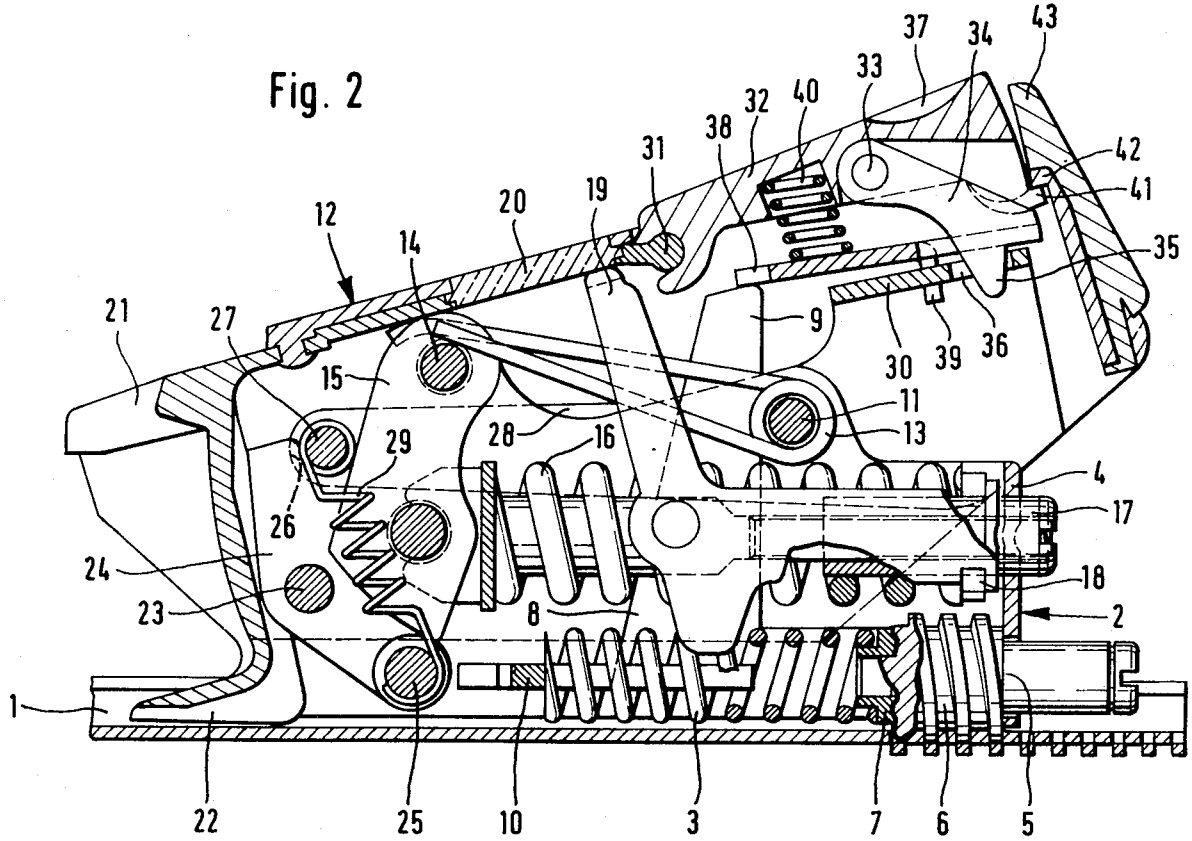

An embodiment of the invention will now be described in detail and by way of example with reference to the accompanying drawings, in which FIG. 1 is a central longitudinal sectional view showing the heelholder in its open position and FIG. 2 is a similar view showing the heelholder when there is no skiing boot in the binding.

The heelholder has a baseplate 1, which is adapted to be secured in the conventional manner to the top of a ski. A carriage 2 is mounted on the baseplate and slidable thereon in the longitudinal direction of the ski. The carriage 2 is biased by a contact pressure spring 3, which holds the carriage 2 in its forward end position when no skiing boot is held in the binding. That end position is defined by the engagement of the rear end wall 4 of the carriage 2 with a collar 5 carried by an adjusting screw 6. The screw threads of the screw interengage with mating screw threads in the baseplate 1. The contact pressure spring 3 bears on the adjusting screw 5 with a spring abutment 7 interposed, which constitutes part of a member 8. A vertical leg 9 of the member 8 has a free end, which constitutes a stop, the purpose of which will be described hereinafter. The contact pressure spring 3 bears on a crosspiece 10, which extends between the side walls of the housing 2.

A pivot pin 11 is secured in the side walls of the carriage 2. A soleholder designated 12 is mounted on the pivot pin 11 and is biased by an opening spring 13, which consists of a spiral spring that is subjected to bending and tends to move the soleholder to its open position, shown in FIG. 1. The opening spring is mounted on the pivot 11 and adjacent to the carriage bears on a transverse pivot pin 14, which is mounted in the side walls of the carriage 2 and parallel to the pivot pin 11. A first locking lever 15 is mounted on the pivot pin 14 and is biased by a release-controlling spring 16, which bears on the rear end wall 4 of the carriage with an adjusting screw 17 interposed. A spring abutment is formed by a nut 18, which is non-rotatably mounted in the carriage 2 and in mesh with the adjusting screw. The nut 18 is coupled to a pointer 19, which is visible through a window 20 in the top of the carriage 2 and indicates the set force required for a release.

The soleholder 12 comprises a conventional holding-down portion 21 and a spurlike pedal 22. An actuating means in the form of a lever 24 is mounted on a horizontal transverse pivot pin 23 for a limited pivotal movement. That lever 24 is two-armed and at its forward end carries a detent roller 25, which is intended to cooperate with the first locking lever 15. The upper end portion of the lever 24 is formed with a depression 26 for receiving a locking pin 27. That locking pin is seen at the left-hand end of a second locking lever 28, which is mounted in the carriage on the pivot pin 11. A retaining spring 29 consisting of a helical tension spring is connected between the locking pin and the axle of the detent roller 25 and normally holds the locking pin 27 in the depression 26 of the lever 24. The second locking lever 28 consists of a bent sheet metal stamping having two congruent legs and a web 30 connecting said legs. The web 30 and the locking pin 27 are disposed on opposite sides of the pivot pin 11.

The soleholder 12 is formed with a bead 31, on which one arm 32 of a handle or toggle joint is pivoted on an axis which is parallel to the axis of the transverse pivot pin 23. A second arm 34 of the toggle joint is connected to the first arm 32 by a hinge 33 and is provided at its free end with an offset nose 35, which extends into an opening 36 in the web 30 of the second locking lever 28. The arm 32 of the toggle joint has an extension beyond the hinge 33. That extension is formed with a depression 37, which is adapted to receive a fingertip or the tip of a ski pole for actuating the toggle joint.

The interposed member 38 provided in accordance with the invention is disposed between the toggle joint 32, 33, 34 and the second locking lever 28 and consists of a sheet metal stamping formed with right-angled lugs 39. The member 38 extends substantially over the web 30 of the second locking lever 28. The lug 39 extends into an aperture of the second locking lever 28 with an adequate backlash so that the interposed member 38 is capable of an adequate pivotal movement relative to the web 30. A weak helical compression spring 40 bears at one end on the interposed member 38 and at the other end on the toggle joint so that the latter is held in its fully collapsed position shown in FIG. 1. As the interposed member 38 is capable of a limited pivotal movement relative to the web 30, the spring 40 will hold the interposed member against the web 30 on the left of the lug 39 when viewed as in the drawing and against a stop 41 formed on the extension of the toggle arm 32 on the right of the lug 39. The stop 41 forms on the outside a nose, which extends behind and engages an edge portion 42 of a rear transverse wall 43 of the soleholder 12 to limit the outward movement of the toggle joint.

When the heelholder is in its open position, shown in FIG. 1, the skier can step into the binding by inserting the toe portion of his skiing boot into the toe unit, not shown, and then lowering the heel portion of his boot so that the rear end portion of the sole engages the spurlike pedal 22 and the soleholder 12 is moved in the counter clockwise sense when viewed as in the drawing. The soleholder and the carriage 2 are moved at the same time to the right against the force of the contact pressure spring 3. As the holding-down member is turned down, the detent roller 25 forces back the first locking lever 15 against the force of the release-controlling spring 16. The soleholder 12 is then held down by the first locking lever 15, which engages the detent roller 25.

For an arbitrary opening of the heelholder, the arm 32 of the toggle joint can be depressed. As a result, the toggle joint is extended so that the second locking lever 28 is turned about the pivot pin 11, so that the locking pin 27 disengages the depression 26 of the lever 24 and when the soleholder 12 is turned in the clockwise sense the detent roller 25 carried by the lever 24 can roll around the first locking lever 15, which is held in its forward end position. When the skiing boot has separated from the heelholder, the opening spring 13 moves the soleholder 12 to its open position, which is shown in FIG. 1, and the spring 40 returns the toggle joint to its initial position. Under the influence of the retaining spring 29, the locking pin 27 is pulled back into the detent depression 26 of the lever 24.

When the holding-down portion 21 of the soleholder 12 is subjected to an upwardly directed force which exceeds the opposing force of the release-controlling spring 16, the first locking lever 15 will be turned back to cause a conventional safety opening of the heelholder, which then assumes again its position shown in FIG. 1.

When the skiing boot is released at the toe unit, not shown, the contact pressure spring 3 will cause the carriage 2 and the soleholder 12 to move to the left in the drawing until the rear transverse wall 4 of the carriage engages the collar 5 of the adjusting screw 6. Before that engagement, the free end portion of the interposed member 38 strikes against the lug 9 of the member 8, which is fixed to the baseplate. As a result, the second locking lever 28 is turned about the pivot pin 11 so as to unlock the lever 24. The detent roller 25 can now roll around the first locking lever 15 and the opening spring 13 can move the soleholder 12 to the position shown in FIG. 1.

To ensure that the heelholder need not be in its open position when the binding is transported or stored, the heelholder can be held in its closed position also when there is no skiing boot in the binding. This can be effected as follows. When the heelholder is in the position shown in FIG. 1, the toggle arm 32 is depressed so that the toggle joint is extended and the locking pin 27 carried by the second locking lever 28 is disengaged from the depression 26 of the lever 24. While the arm 32 is depressed, the soleholder 12 is turned to its closed position shown in FIG. 2. Because the carriage 2 is not displaced against the force of the contact pressure spring 3, the free end of the interposed member 38 is not moved past the free end of the lug 9. When the arm 32 of the toggle joint is then released, the retaining spring 29 causes the locking pin 27 to be pulled into the depression 26 so that the lever 24 will be locked. At the same time, the lug 9 holds back the interposed member 38 against the force of the weaker spring 40 so that the interposed member 38 does not follow the second locking lever 28. As a result, the stop for automatically opening the heelholder is disabled and the heelholder remains closed.

When the heelholder is closed and the skier desires to step into the binding, only the toggle arm 32 must be depressed so that the lever 24 will be unlocked and the heelholder will open automatically.

What is claimed is:

1. A heelholder for a safety ski binding extending in a longitudinal direction for attachment to a ski, said heelholder comprising:

a soleholder pivotably mounted on a support on a horizontal axis for movement between open and closed positions;

opening spring means biassing said soleholder towards the open position;

a first locking member mounted for movement in the longitudinal direction on said soleholder;

release controlling spring means biassing said first locking member in the forward direction;

actuating means mounted on said soleholder, said actuating means being releasably engageable by said first locking member when said soleholder is in the closed position to releasably retain said soleholder in the closed position;

a second locking lever movably mounted on the support and having a locking condition for releasably locking said actuating means in engagement with said first locking member to releasably retain said soleholder in the closed position;

retaining spring means biassing said second locking member to said locking condition;

manual release means for moving said second locking member out of said locking condition for manually moving said soleholder from the closed position to the open position;

stop means fixed relative to the soleholder; and an interposed member disposed between said manual release means and said second locking member, said stop means cooperating with said interposed member for moving said second locking member out of the locking condition when a ski boot is moved out of the soleholder in its closed position without overcoming the bias of said release controlling spring, and said interposed member being disabled from moving said second locking lever out of the locking condition upon actuation of said manual release means during movement of the soleholder from the open position to the closed position.

2. The heelholder according to claim 1 and further comprising:

a baseplate mountable on a ski;

a carriage mounted for longitudinal movement on said baseplate, said carriage supporting said soleholder; and contact pressure spring means biassing said carriage in the forward direction;

wherein said stop means is fixed relative to said baseplate.

3. The invention according to claim 1 wherein said manual release means comprises a handle pivotally mounted on said soleholder.

4. The invention according to claim 3 wherein said handle comprises a toggle joint.

5. The invention according to claim 1 wherein said second locking member comprises a two-armed lever mounted for pivotal movement about an axis located between the two arms of said lever, one of said arms being engageable with said actuating means when said second locking member is in the locking condition, and the other of said arms being engageable by said interposed member for moving said second locking member out of the locking condition during said cooperation of said stop means and said interposed member.

6. The invention according to claim 5 wherein said interposed member is pivotally mounted on said other arm of said second locking member, said heelholder further comprising spring means biassing said interposed member towards said second arm.

7. The invention according to claim 6 wherein said spring means is attached to said manual release means.

8. The invention according to claim 1 wherein said heelholder comprises a base plate, and a carriage on the base plate, and wherein said first locking member comprises a lever pivotally mounted on said carriage.

* * * * *